United States Patent [19]

Kuintzle, Jr.

[11] 3,977,811

[45] Aug. 31, 1976

[54] AIR PUMP FOR USE IN DUSTY ENVIRONMENT

[75] Inventor: Charles Kuintzle, Jr., Monroe, Conn.

[73] Assignee: Avco Corporation, Stratford, Conn.

[22] Filed: Oct. 23, 1975

[21] Appl. No.: 624,867

[52] U.S. Cl. ..... 415/121 G; 415/209; 55/306; 302/23; 137/15.1; 60/39.09 P

[51] Int. Cl.[2] ..... F04D 29/70

[58] Field of Search ..... 415/121 G, 209, 77, 415/79; 60/39.09 P; 55/306; 302/23; 417/65, 71; 137/15.1

[56] References Cited

UNITED STATES PATENTS

| | | | |
|---|---|---|---|
| 3,035,792 | 5/1962 | Klapproth | 55/306 |
| 3,302,395 | 2/1967 | Robbins | 244/53 B |
| 3,362,155 | 1/1968 | Driscoll | 55/306 |
| 3,616,616 | 11/1971 | Flatt | 415/79 |
| 3,766,719 | 10/1973 | McAnally | 244/53 B |

FOREIGN PATENTS OR APPLICATIONS

| | | | |
|---|---|---|---|
| 586,566 | 3/1947 | United Kingdom | 415/79 |

*Primary Examiner*—Henry F. Raduazo
*Attorney, Agent, or Firm*—Robert J. McNair, Jr.; Irwin P. Garfinkle

[57] ABSTRACT

Apparatus is disclosed for pumping gases laden with abrasive particles. The pump comprises a cylindrical outer housing within which there are three axially adjacent sections, namely; an inertial bypass inlet; a powered rotor midsection; and an annular exhaust diffuser. The inertial bypass inlet consists of an axially symmetric cone which diverts the heavier sand and dust particles toward the outer walls. Behind the conical deflector is an axially symmetric circular shroud. A rotor within the shroud draws in and accelerates partially clean air from the lee side of the cone while the majority of the sand and dust laden air passes between the shroud and the outside wall. Recombination of the entire airstream occurs at an ejector nozzle serving as an output of the powered rotor midsection. Contaminated air from the ejector nozzle experiences a pressure rise in the annular exhaust diffuser.

7 Claims, 3 Drawing Figures

AIR PUMP FOR USE IN DUSTY ENVIRONMENT

BACKGROUND OF THE INVENTION

Particle separators are used to remove sand and dust from the air intake of gas turbine engines. A small fraction of the incoming air is often diverted to accomplish scavenging of the sand and dust from the separator. The pump that aids in the scavenging operation has to function in a very contaminated environment since there is a very high concentration of sand and dust in the separator exhaust air stream. Sand particles seriously pit and degrade the performance and life expectancy of a conventional bladed-fan type air pump when the gas turbine engine is used in a desert area.

My invention solves the fan blade erosion problem by means of an air pump provided with a self-bypassing path for the dirtiest fraction of the gas stream. The pump uses a dirt deflector installed upstream from the pump rotor blades. The deflector consists of a cone shaped inertial bypass which diverts the heavy sand and dust particles away from the pump's rotor blade which operates within a circular shroud located on the lee side of the deflector. Most of the sand and dust remains in the airstream passing between the periphery of the shroud and the outside wall of the apparatus. Air passing through the rotor blade stage recombines with the main stream of dirt laden air at an annular shaped ejector nozzle just downstream of the rotor blades. The high velocity turbulent air at the output of the ejector nozzle slows as it traverses the annular diffuser stage, at the same time undergoing an increase in pressure.

The self-bypassing feature of my invention greatly improves rotor durability for air pumps delivering large volumes of sand and dust laden air on a continuing basis.

SUMMARY OF THE INVENTION

This invention pertains to an air pump which has a long life even when used in a sand and dust laden environment. The pump consists of three axially spaced annular stages. At the inlet, the incoming air strikes the tip of an axially symmetric conical section. This conical section which at its maximum diameter about half fills the inside cross sectional area of the inlet chamber, diverts the heavier sand and dust particles toward the outer walls. Behind the cone shaped deflector there is, in the second stage, an axially symmetric circular shroud having a diameter approximately the same as the maximum diameter of the above mentioned cone. A bladed rotor operates within the shroud to accelerate air through the pump. Air drawn through the rotor is relatively clean since it comes from the lee side of the cone and the heavier dust and sand particles cannot make the sharp bend around the cone base to enter the shroud enclosed area. Rather, the major portion of the sand and dust remains in the airstream passing through the annular region between the shroud and the outer walls. High speed, relatively clean air from the rotor, recombines with the annular shaped stream of dirt laden air at an ejector nozzle section located downstream of the rotor. The recombination of the high velocity airstream from the rotor with dirt laden air outside the shroud serves to accelerate the annular shaped stream passing between the shroud and the outer wall. The recombined airstream is then passed through an annular shaped diffuser stage from which it is exhausted either overboard or into some sort of scavenge collection vessel.

Properly configured, the self-bypassing feature of my invention, can result in a pump which delivers several hundred liters of air per second across a pressure head increase of about 10 percent.

BRIEF DESCRIPTION OF THE DRAWINGS

Having generally described the invention, the accompanying drawings are shown by way of illustration of a preferred embodiment thereof, in which.

DESCRIPTION OF THE PREFERRED EMBODIMENT

Figure 1:
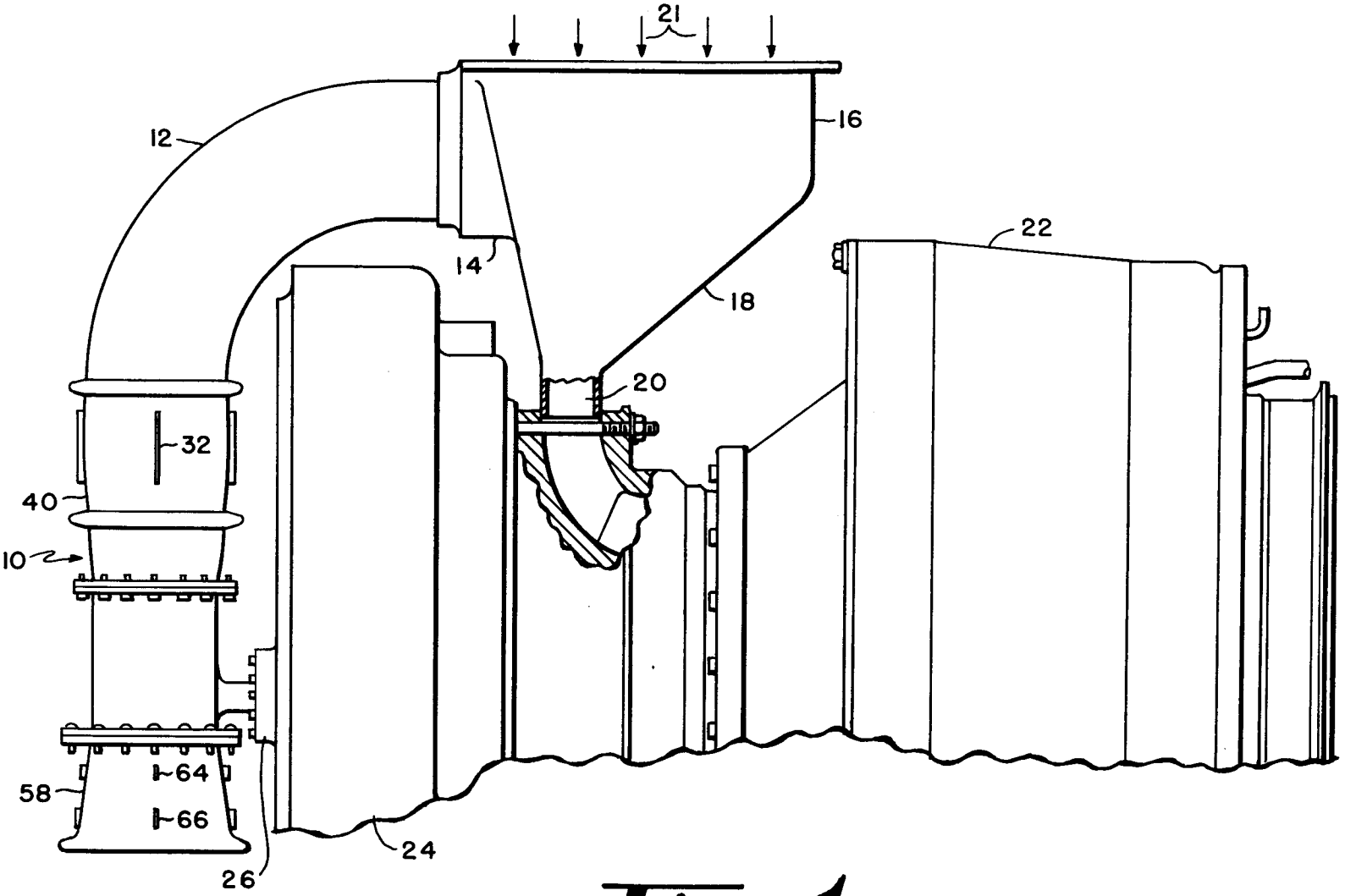
FIG. 1 shows the air pump connected to the scavenge manifold of the particle separator used on a gas turbine engine.

In FIG. 1 there is shown an air pump 10 connected by means of pipe 12 to scavenge manifold 14 of particle separator 16. Particle separator 16 may be of the type shown in the U.S. Pat. application Ser. No. 567,243. The separator having air inlet 21 is secured by suitable means, such as scroll 18 and inlet duct 20, to the air intake of gas turbine 22. Separator 16 removes dust and other particles from the air prior to its entry into the inlet 20, and deposits the contaminants in scavenge manifold 14. Gear box 24 coupled to the central shaft of the gas turbine furnishes power through shaft housing 26 to drive the air pump 10. Air pump 10 serves to remove the particles from the scavenge manifold 14. In actual practice pump 10 is proportionately much smaller with respect to gas turbine 22 than is depicted in FIG. 1.

Figure 2:
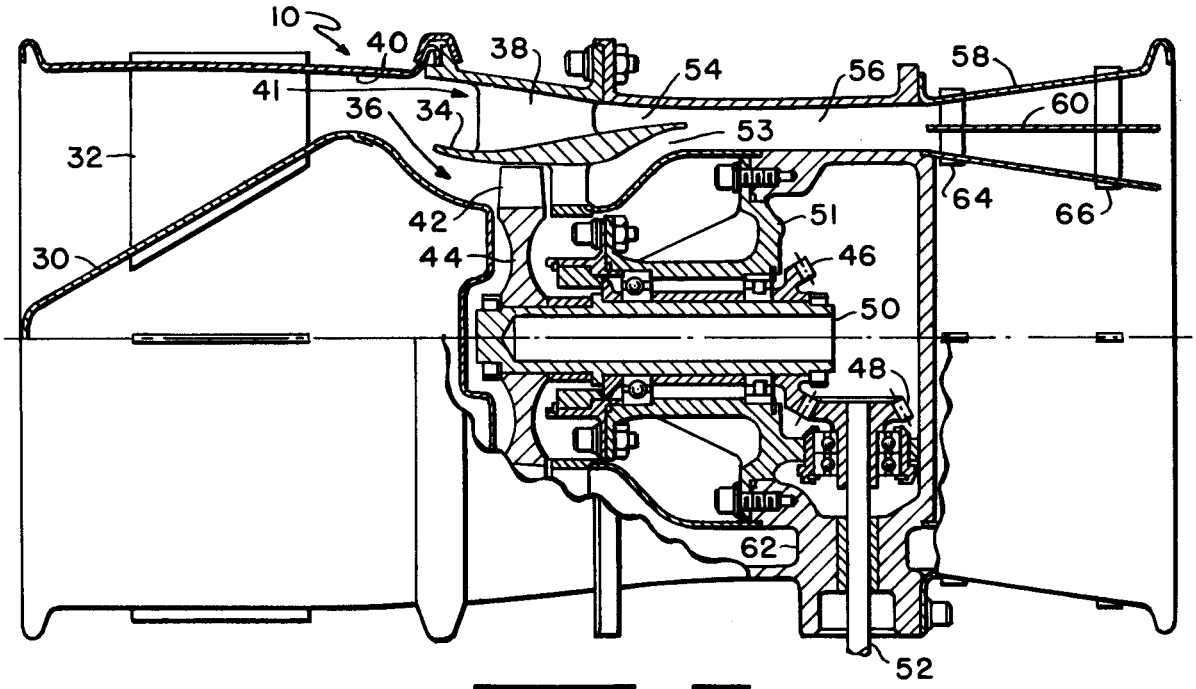
FIG. 2 shows a cross sectional view of a self-bypassing type air pump having an axial flow rotor.

Referring now to FIG. 2 there is shown a partially cutaway view of the interior of one of the self-bypassing type air pumps having an axial flow rotor. The pump 10 consists of an outer pipe 40 of circular cross section. Inlet air entering pipe 40 is diverted radially outward by deflector cone 30. A series of axially extending radial inlet struts 32 serves to support the cone 30 and to direct the incoming airstream down the interior of the pipe. As shown inlet struts 32 are axially aligned and therefore the airstream will be guided straight down the interior of the pipe. In some implementations, it may be desirable to have struts 32 set in at an angle so as to impart either a clockwise or counterclockwise twist to the airstream.

An annular shroud 34 is positioned on the lee side of conical deflector 30, and it serves to divide the airstream exiting from the cone section. The heavier sand and dust particles entrapped in the incoming airstream will be deflected outward toward pipe 40 by conical deflector 30. On reaching the outer annular passageway 41 between shroud 34 and pipe 40, the heavy sand and dust particle laden air will flow therebetween. Support struts 38 are of streamlined cross section and serve to hold axially extending shroud 34 in place. Struts 38 which are placed at equi-angle intervals around the interior of the pump also serve to direct the flow of air. In the unit reduced to practice struts 38 were oriented so as to be aligned with inlet struts 32.

Between the leading edge of shroud 34 and the trailing wall of conical deflector 30 there is an annular shaped inertial bypass inlet 36. It is through annular bypass inlet 36 that relatively clean air is drawn into an inner axially extending passageway by the multiplicity of blades 42 of rotor 44. Rotor 44 is mounted on one end of shaft 50 which is journaled for rotation by means of bearings set in support member 51. Bevel gear 46 on the other end of shaft 50 receives driving power from mating gear 48 which is also journaled for rotation on support member 51. Input driving shaft 52 delivers power to gear 48. In the unit reduced to practice rotor 44 was configured to operate at a speed of 50,000 rpm. Power for the shaft 52 is derived from gear box 24 through housing 26 as seen in FIG. 1.

Air drawn into bypass inlet 36 by rotor blades 42 will contain only a small fraction of the sand and dust present at the pump inlet. This is because the bypass inlet is located on the lee side of deflector cone 30. The outward acceleration imparted to the heavier sand and dust particles by deflector cone 30 prevents them from making the sharp turn required to get into bypass inlet 36. As a result the air passing through rotor blades 42 is much cleaner than is the case for an air pump having a conventional bladed fan.

Air passing within the shroud is accelerated by rotor blades 42 such that it exits at high velocity through annular shaped ejector primary nozzle 53. The high velocity air issuing forth from ejector primary nozzle 53 serves to expel the contaminated bypass air flowing in region 41 through ejector secondary nozzle 54. The ratio of flow pumped by the ejector through region 41 along the outside of shroud 34 to that passed by the rotor blades 42 can be varied as a key system parameter. As the bypass flow rate is increased, the total pressure applied to the ejector primary nozzle must increase along with the input power requirements of the rotor. The offsetting advantage accruing to the use of a high bypass ratio is that sand separation efficiency improves, which in turn increases rotor durability. For a particular implementation, trade-off analyses have to be made between power requirements and life expectancy. In the FIG. 2 unit reduced to practice a bypass ratio of 0.2 was chosen wherein 5 times as much air flowed through the rotor as flowed through the bypass. Use of a 0.2 bypass ratio in the FIG. 2 implementation resulted in a rotor pressure ratio of 1.16 and a rotor power drain requirement of 8 Hp for an air pump delivering 0.9 lbs./sec.

Air leaving ejector nozzles 53 and 54 enters mixing tube region 56 wherein the heavy sand and dust particles become equilibrated throughout the moving air mass. Region 56 is situated between the outer shell 40 of the air pump and an inner shell which protects the mechanical drive mechanism. Shaft 52 passes at right angles through a housing 62 which penetrates region 56 in the manner shown in FIG. 2.

The mixing tube region is followed by an annular exhaust diffuser 58. Diffuser 58 is compact in nature having a low length to diameter ratio. A diffuser splitter vane 60 is used to retard flow separation. Splitter vane 60 consists of a thin sheet of metal of cylindrical cross section suspended within diffuser 58 by means of a multiplicity of struts 64 and 66 which are spaced at regular intervals around the annular diffuser. The annular diffuser serves to slow the exhaust gas and at the same time cause the gas to undergo a pressure rise.

Figure 3:
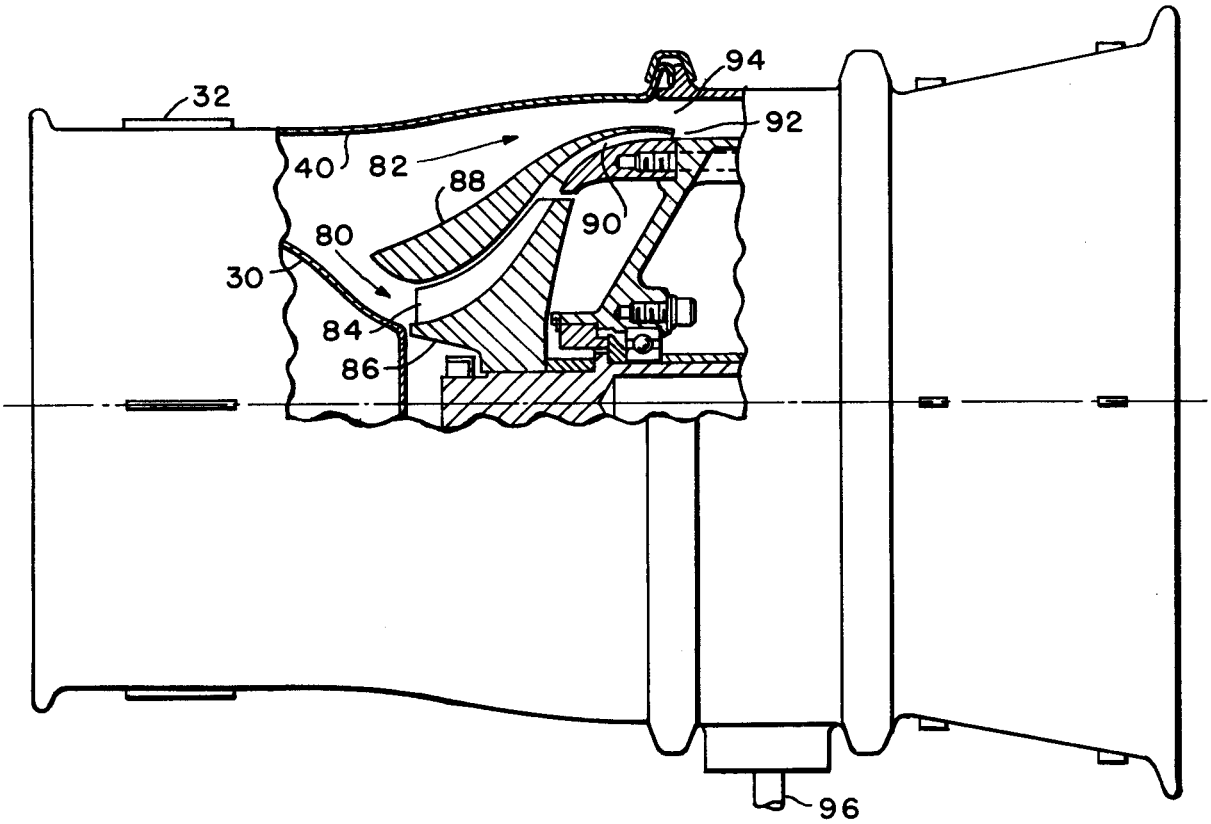
FIG. 3 shows a cross sectional view of a self-bypassing type air pump having a mixed flow centrifugal rotor.

In the FIG. 3 implementation, the inlet and the annular diffuser stages are similar to those of FIG. 2. The second stage is different as shown in the partially cut away view of FIG. 3. At the inlet, conical deflector 30 and inlet struts 32 serve to divert the heavy sand and dust particles outward toward wall 40. In the second stage inertial bypass inlet 80 delivers relatively uncontaminated air to rotor 86. Rotor 86, however, is different from the rotor of FIG. 2. Blades 84 on rotor 86 form a centrifugal impeller. Impeller blades 84 are of conventional configuration. Air comes off the periphery of an impeller at an angle which approximates a tangent to the circumference. To turn this air flow back to an axial direction there is inserted in the air channel a row of curved accelerating vanes 90 connected between shroud 88 and the inside wall. Accelerating vanes 90, in cross sectional view, approximate the arc of a circle. Their purpose is to direct air in an axial direction through ejector primary nozzles 92. High velocity air exiting ejector primary nozzle 92 draws contaminated air through ejector secondary nozzle 94. From this point on, the air pump functions in a manner similar to that described for the FIG. 2 implementation.

The bypass ratio of the FIG. 3 arrangement is higher than for the FIG. 2 implementation. In the FIG. 3 unit reduced to practice, the bypass ratio was 1.0. In other words the same volume of air flowed on the outside of shroud 88 (Airpath 82) as flowed through impeller blades 84. As the bypass ratio is raised from the 0.2 value used in the FIG. 2 pump to the 1.0 value of the FIG. 3 pump, progressively higher pressure ratios are required at the ejector primary nozzle. The advantage gained, however, is an improved sand separation efficiency. With the bypass ratio of 1.0 used in the FIG. 3 implementation, a pressure ratio of 1.59 was found to exist between the primary and secondary ejector nozzles. The increase in pressure ratios resulted in a power requirement at shaft 96 of FIG. 3 of 16 Hp for an air pump having a flow rate of 0.9 lb. per sec. This is about twice the power requirement for the same size pump when implemented in the FIG. 2 configuration. Thus there is a tradeoff between power required to drive the pump and the amount of sand and dust that is allowed to flow through the rotor. Those using my invention can make trade-off analyses between power requirements and rotor durability, depending upon the bypass ratio selected for the air pump.

It will be understood that the air pump arrangement, while presently disclosed in cooperative relation with the air separator used on gas turbine engines may be utilized for pumping sand and particle laden air in a multiplicity of other applications. For example, many types of air pumps are used to create a hazard free environment for workers in both factories and mines. Some of these pumps operate in environments where use of my invention would greatly enhance their reliability.

I claim:

1. Apparatus for use in pumping particle laden gases comprising:

a housing having a generally cylindrical passageway therethrough, said passageway having an inlet and an outlet;

deflector means supported at said inlet for imparting an inertial force to incoming particles for directing them toward the housing wall;

a driven bladed rotor mounted in an intermediate region of said passageway;

an axially extending shroud of circular cross section surrounding said bladed rotor and dividing said passageway into inner and outer axially extending passageways, the leading edge of said shroud being adjacent the lee side of said deflector means and forming therebetween an annular inlet in communication with the inlet side of said bladed rotor; and an annular shaped ejector nozzle at the trailing edge of said shroud having a primary nozzle in communication with the outlet of said bladed rotor and having a secondary nozzle in communication with said annular outer passageway on the outside of said shroud, whereby gases drawn through said annular inlet by said bladed rotor and forced at high velocity through said ejector primary nozzle provides a pressure drop for drawing particle laden gases through the ejector secondary nozzle and from the annular outer passageway.

2. The invention as defined in claim 1, and a mixing region in communication with said ejector nozzles.

3. The apparatus as defined claim 2 and including an axially symmetric annular shaped diffuser stage in communication with the outlet end of said mixing region, said diffuser being adjacent to the outlet end of said pump housing.

4. The apparatus as defined in claim 3 wherein said annular shaped diffuser stage includes a splitter vane whereby flow separation is retarded.

5. The apparatus as defined in claim 1 wherein said deflector means comprises a conical section having its tip end facing said passageway inlet and being supported by equi-spaced radial inlet struts connecting said conical section with said housing, said conical section being at its largest diameter, smaller than the interior diameter of said housing whereby said conical section acts as an inertial bypass for particles suspended in incoming gases.

6. The apparatus as defined in claim 5 wherein each of said equi-spaced radial inlet struts has an axially extending span width whereby the incoming airstream is made to follow a directed flow path as it passes down the interior of said pump.

7. The apparatus as defined in claim 1 wherein the ratio of gases pumped by said ejector nozzle along the outside of said shroud to that passing though said rotor blades ranges between 0.2 and 1.0.

* * * * *